US012304690B2

(12) United States Patent
Bowser

(10) Patent No.: US 12,304,690 B2
(45) Date of Patent: May 20, 2025

(54) NAUTICAL FIBERGLASS CONTAINER TO STORE AND PROTECT MARITIME DEWATERING PUMP AND STORAGE SPILL KITS

(71) Applicant: Gregory Lee Bowser, Charlotte, NC (US)

(72) Inventor: Gregory Lee Bowser, Charlotte, NC (US)

( * ) Notice: Subject to any disclaimer, the term of this patent is extended or adjusted under 35 U.S.C. 154(b) by 0 days.

(21) Appl. No.: 18/337,555

(22) Filed: Jun. 20, 2023

(65) Prior Publication Data

US 2024/0425224 A1 Dec. 26, 2024

(51) Int. Cl.
*B65D 1/40* (2006.01)
*B65D 25/28* (2006.01)
*B65D 53/06* (2006.01)

(52) U.S. Cl.
CPC ..... *B65D 1/40* (2013.01); *B65D 25/2826* (2013.01); *B65D 53/06* (2013.01)

(58) Field of Classification Search
CPC ..... B65D 1/40; B65D 25/2826; B65D 53/06
USPC ..... 220/326; 292/DIG. 11
See application file for complete search history.

(56) References Cited

U.S. PATENT DOCUMENTS 4,234,096 A * 11/1980 Hergaux ..... B65F 1/1607 220/254.2
5,310,073 A * 5/1994 Johannsson ..... A22B 7/008 220/592.2
6,286,707 B1 * 9/2001 Hall ..... B65D 90/028 220/592.2
2006/0032860 A1 * 2/2006 Hase ..... B65D 43/24 220/831
2008/0119536 A1 * 5/2008 Chubb ..... C07D 403/12 514/400

* cited by examiner

*Primary Examiner* — James N Smalley

(57) ABSTRACT

A maritime dewatering pump container having an auxiliary function as a storage spill kit. The container is made from fiberglass and provides a base and a lid, wherein the base defines a compartment dimensioned and shaped to house a maritime dewatering pump. A bottom of the base may be reinforced with oriented salt-treated strand board. An upper portion of the base has an opening providing access to the compartment. A periphery of the base opening provides a water-resistant seal that engages a periphery of the lid. First clamping mechanisms along of the lid periphery operatively associate with second claiming mechanisms downward of the opening periphery so as to selectively urge the water-resistant sealing when the lid is in a closed condition relative to the base.

9 Claims, 4 Drawing Sheets

NAUTICAL FIBERGLASS CONTAINER TO STORE AND PROTECT MARITIME DEWATERING PUMP AND STORAGE SPILL KITS

BACKGROUND OF THE INVENTION

The present invention relates to dewatering pumps and more particularly, to a nautical fiberglass container to store and protect a maritime dewatering pump, wherein the container also functions as a storage spill kit.

Dewatering is the removal of water from a location. Maritime dewatering is critical when watercraft takes on water, wherein dewatering removes the taken-on water from the vessel. Typically, a dewatering pump is employed in such instances. When the dewatering pump is exposed to salt water, however, its valves can seize up, rendering it effective useless. Moreover, many current dewatering systems are made from, at least in part, porous aluminum, which is degraded by saltwater, causing cracks and deterioration, which leads to problems with the dewatering pumps.

Current containers for dewatering pumps are heavy and only serve one purpose. Moreover, current dewatering pump containers are made of a non-durable material and are expensive. Furthermore, such containers limit customization.

A need exists for a nautical fiberglass container to store and protect a maritime dewatering pump, wherein the container also functions as a storage spill kit.

SUMMARY OF THE INVENTION

The container embodied in the present invention, relative to the prior art, is less expensive, is lighter, and is made with more durable material which will better protect the dewatering pump or other materials placed in it. The present invention is also multipurpose, while the prior art only serves one, limited purpose.

The present invention embodies an airtight weather resistant container that protects the dewatering pump, preventing saltwater damage. The present invention is made with fiberglass making it lighter, less expensive, more durable, and easier to modify compared to the prior art. Also, the present invention is dimensioned and shaped to serve as a storage for other damage control or safety equipment.

In one aspect of the present invention, a maritime dewatering pump container that functions are a storage spill kit, said container includes the following: a fiberglass base having a bottom and a plurality of sidewalls that form a compartment, wherein an upper portion of the base defines an opening providing access to the compartment; a water-resistant sealant along a periphery of the opening; and a fiberglass lid movable between an open condition and a closed condition forming a water-resistant seal of the opening.

In another aspect of the present invention, the maritime dewatering pump container further includes a first clamping mechanism along the lid; and a second clamping mechanism just downward of the periphery of the opening, wherein the closed condition, the first and second clamping mechanism are selectively associable to increase the water-resistant seal of the opening, wherein the first clamping mechanism comprises spaced apart flexible T-handles, and wherein the second clamping mechanism comprises spaced apart securing posts, wherein the plurality of sidewalls interconnects by way of curved edges, wherein the lid is frustrum in shape; and further including a handle attached to the lid, wherein the bottom is reinforced with oriented salt-treated strand board, wherein the bottom provides a plurality of legs, wherein the compartment is dimensioned and shaped to house a maritime dewatering pump, and wherein the compartment is dimensioned and shaped to house emergency equipment in additional to the maritime dewatering pump.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a maritime dewatering pump container having an auxiliary function as a storage spill kit. The container is made from fiberglass and provides a base and a lid, wherein the base defines a compartment dimensioned and shaped to house a maritime dewatering pump. A bottom of the base may be reinforced with oriented salt-treated strand board. An upper portion of the base has an opening providing access to the compartment. A periphery of the base opening provides a water-resistant seal that engages a periphery of the lid. First clamping mechanisms along of the lid periphery operatively associate with second claiming mechanisms downward of the opening periphery so as to selectively urge the water-resistant sealing when the lid is in a closed condition relative to the base.

Figure 1:
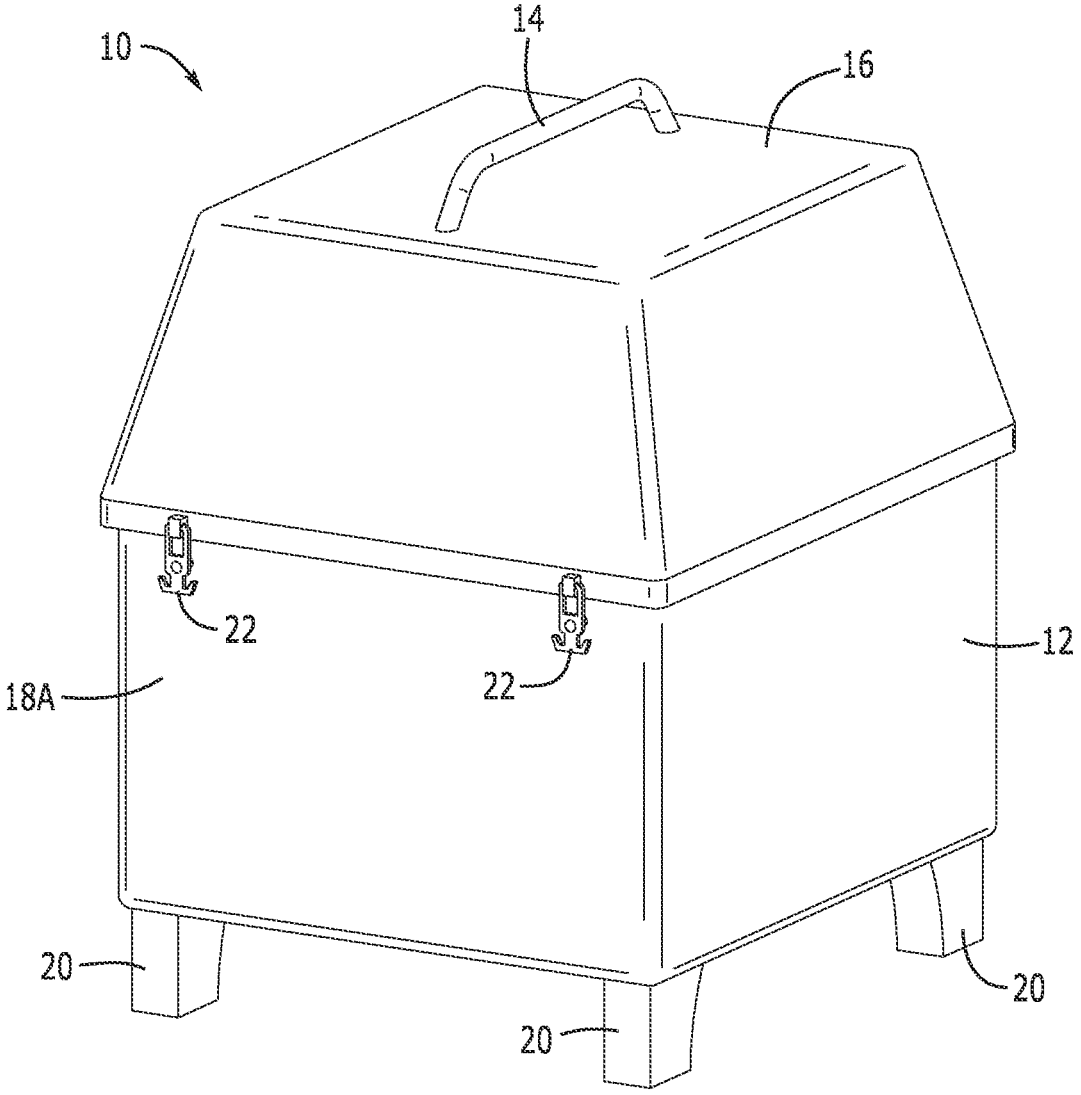
FIG. 1 is a front perspective view of an exemplary embodiment of the present invention.
Figure 2:
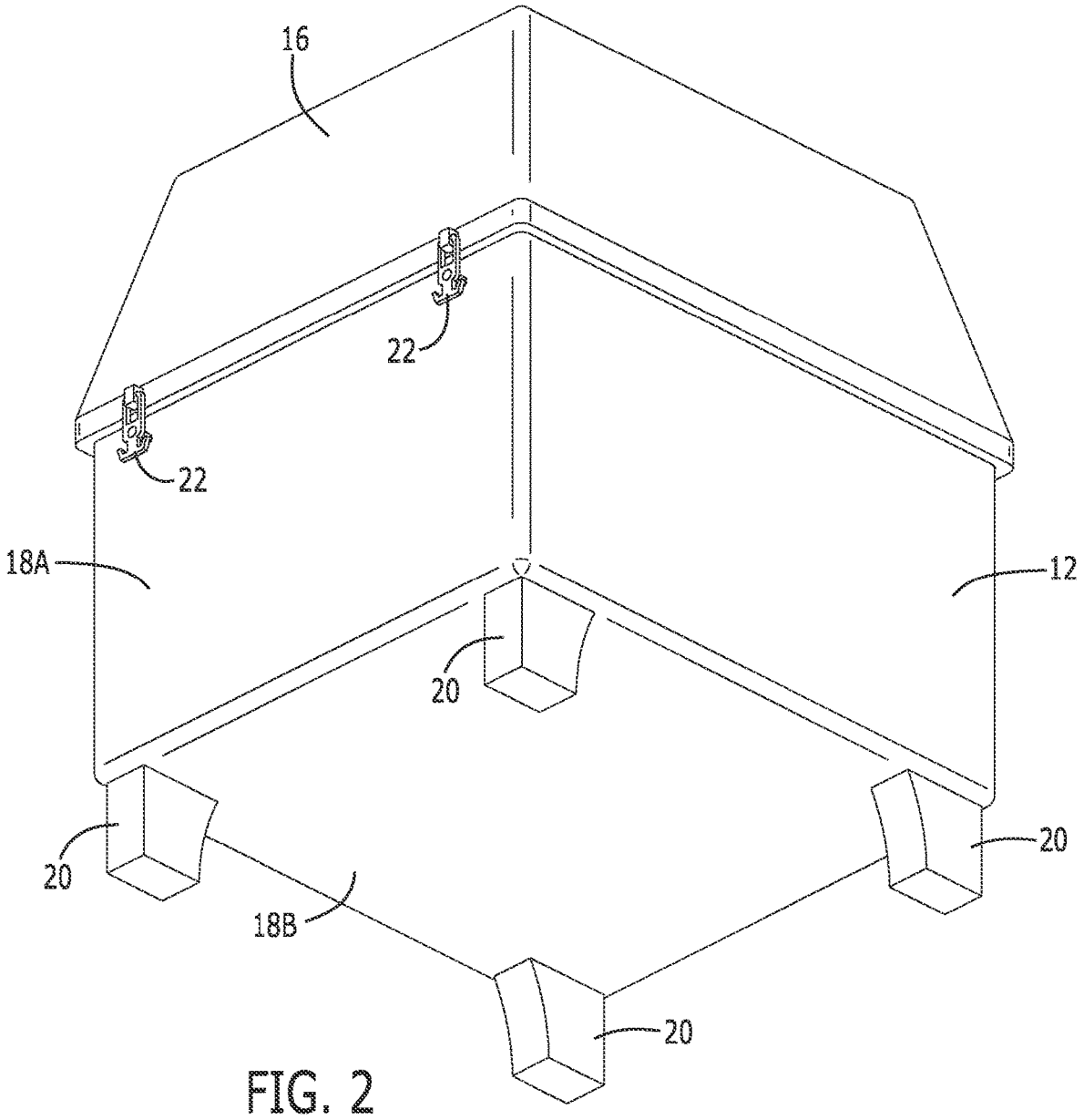
FIG. 2 is a bottom perspective view of an exemplary embodiment of the present invention.
Figure 3:
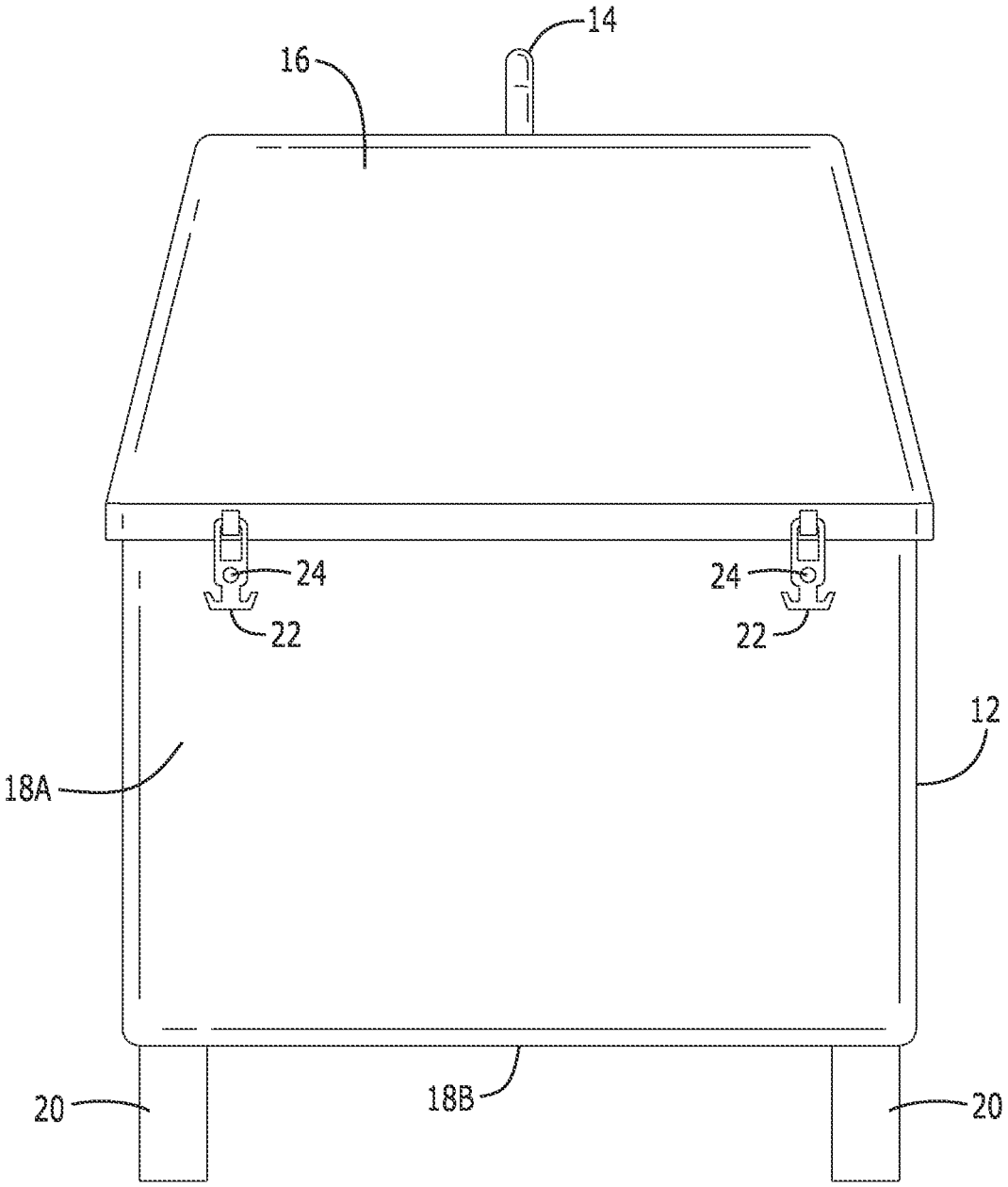
FIG. 3 is a front elevation view of an exemplary embodiment of the present invention.
Figure 4:
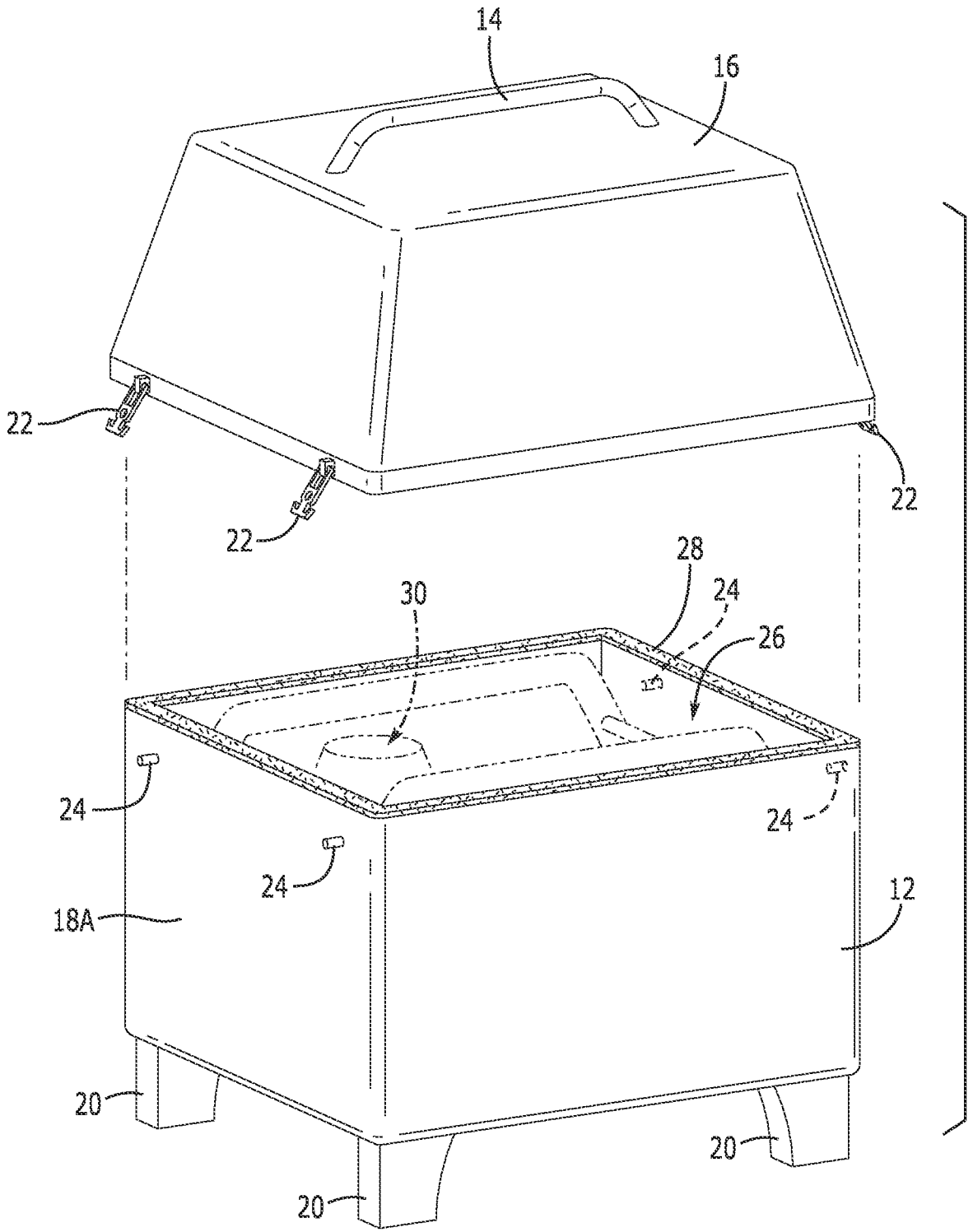
FIG. 4 is an exploded perspective view of an exemplary embodiment of the present invention.

Referring to FIGS. 1 through 4, the present invention may include a dewatering pump container 10 that functions are a storage spill kit. The dewatering pump container 10 provides a base 12 defining a storage compartment 26 accessible through an opening defined by an upper periphery of the base 12, as seen in FIG. 4. The upper periphery may provide a water-resistant and/or hermitical seal 28. Just downward of said upper periphery may be spaced apart securing posts 24. In the embodiments where the base 12 is defined by rectangular (as opposed to round/circular) sidewalls 18A, the securing posts 24 may be on only two (of the four rectangular) sidewalls 18A of the base 12—e.g., on only the front and rear sidewalls 18A, as opposed to be disposed on the right and left sidewalls. Along a bottom surface 18B of the base 12, a plurality of legs 20 may be provided.

A lid 16 may be dimensioned and shaped to operatively associate with said seal 28 to establish a water-resistant and/or hermitical thereto. In some embodiments, a bottom periphery of the lid 16 may provide a complementary water-resistant and/or hermitical seal to facilitate this functionality. Seal 28 may include, but is not limited to, sponge neoprene stripping, which serves as a water and rain resistant seal when the lid 16 periphery is mated with the base 12 periphery. Adjacent to said bottom periphery of the lid 16 may be disposed spaced apart flexible T-handles 22 for engaging the securing posts 24. When the lid 16 engages the seal 28, the flexible T-handles 22 can be pivoted to engage the securing posts 24, clamping of the lid and the base and allow quick access to the shell contents. The lid 16 may provide a handle 14 for users to grab and manipulate. The lid 16 may have a frustum shape (pyramid or cone).

The compartment 26 is dimensioned and shaped to receive at least one dewatering pump 30. These specific dimensions of the hydro-shell are chosen to take less space, while the curved and rounded surface angles of the base 12 and lid 16 edges reduce the chances of injury to personnel that may contact it.

The base 12 and lid 16 may be made from a hydro-shell hand laid fiberglass process, making the shell lightweight, damage resistant from impact, and resistant to saltwater degradation because of a non-porous coating. The top of the hydro-shell is lightweight and the boat handle 14 is strong enough that one person can lift and access the contents inside.

Generally, a method of making the present invention may include the following. First a manufacturer may pull both the lid 16 and base 12 from mold/template. Then the manufacturer may reinforce the core in the base 12. Next the manufacturer may trim the lid 16 and base 12. The manufacturer may chop an approximately ¼-inch thick lid 16. The manufacturer may chop an approximately ⅛-inch-thick base 12. Then the manufacturer may gelcoat the lid 16, the interior (compartment 26), and exterior of the base 12 before buffing the exterior. The base may be sealed to ensure hazardous materials are kept from leaking into surrounding areas. Finally, the manufacturer may fit the hardware 14, 20, 22, 24. The legs 20 may be left blank (no bolt holes) to allow options for securing the hydro-shell to the chosen location.

In one embodiment, a specific method of making the present invention may include the following steps: build a mold from MDF to the inner dimensions of the shell; layer the inside mold with layers of fiberglass cloth applying resin and cloth until the desired thickness is achieved for the top and bottom of the shell; reinforce the bottom with the oriented salt-treated strand board and covered in resin and cloth; when the fiberglass reaches its desired hardness, the two halves are pulled from the molds; trim and sand the two halves to check for high and low spots and ensure that the two halves of the shells fit together as designed; prime, sand, smooth, and clean the two finished halves of all dust, apply gel coat, and polish; apply adhesive to the lip of the base so that sponge neoprene stripping cut to fit can be applied to achieve a water resistant seal; attach flexible rubber T-handle to the base with stainless steel screws; attach the stainless latch to the lid with stainless screws; center the stainless round boat grab handle and attach to the top half of the shell using attached studs and seal the handle with resin to ensure water resistance (though, the handles can be placed in different places on the finished container upon customer preference). The color, handles, shape, size, and how the product is locked into the ground to hold it in place may be altered or modified to taste. The present invention can be molded to be larger or smaller for storage purposes. The invention mold can be customized but the materials must remain the same to make the product.

For naval and sea going vessels, the current containers are supposed to keep the elements from reaching the dewatering pump's spill kits and emergency safety equipment. Prior art containers are heavier and contain material that deteriorates much faster than the container embodied in the present. The present invention is lighter, more durable, takes up less space, and is cost efficient. Not only would the product cost be less over time because it is virtually indestructible, the present invention can handle any modifications, customization, and more because the container embodied therein can also serve as a storage container as well because of its ability to have multiple uses. Because the present invention is used for storage, it will save money by keeping the dewatering pumps and other emergency equipment from water damage (not just the dewatering pump), resulting in less problems that tend to increase operational cost. In short, the present invention will help cut costs and will be lighter to move around.

Additionally, the present invention can be used as a storage bin for any equipment that is threatened when exposed to elements. The product can be customized to protect a multitude of items from elements including water from damaging products other than dewatering pumps. Bigger or smaller, the container can be modified to act as an indestructible storage box.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the present invention.

What is claimed is:

1. A maritime dewatering pump container that functions are a storage spill kit, said container comprising:

a fiberglass base having a bottom and a plurality of sidewalls that form a compartment, wherein an upper portion of the base defines an opening providing access to the compartment;

a seal along a periphery of the opening; and a fiberglass lid free of any openings therethrough and movable between an open condition and a closed condition forming a water-resistant seal of the opening, wherein the bottom is reinforced with oriented salt-treated strand board.

2. The container of claim 1, further comprising:

a first clamping mechanism along the fiberglass lid; and a second clamping mechanism just downward of the periphery of the opening, wherein the closed condition, the first and second clamping mechanism are selectively associable to increase the water-resistant seal of the opening.

3. The container of claim 2, wherein the first clamping mechanism comprises spaced apart flexible T-handles, and wherein the second clamping mechanism comprises spaced apart securing posts.

4. The container of claim 1, wherein the plurality of sidewalls interconnects by way of curved edges.

5. The container of claim 1, wherein the fiberglass lid is frustrum in shape.

6. The container of claim 1, further comprising a handle attached to the fiberglass lid.

7. The container of claim 1, wherein the bottom provides a plurality of legs.

8. The container of claim 1, wherein the compartment is dimensioned and shaped to house a maritime dewatering pump.

9. The container of claim 8, wherein the compartment is dimensioned and shaped to house emergency equipment in additional to the maritime dewatering pump.

* * * * *